US006993875B2

(12) United States Patent
Rudduck

(10) Patent No.: US 6,993,875 B2
(45) **Date of Patent: *Feb. 7, 2006**

(54) BUILDING ELEMENTS

(75) Inventor: Dickory Rudduck, Seaforth (AU)

(73) Assignee: Telezygology Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/268,019

(22) Filed: Oct. 9, 2002

(65) Prior Publication Data

US 2003/0110726 A1 Jun. 19, 2003

Related U.S. Application Data

(63) Continuation of application No. 09/874,509, filed on Jun. 5, 2001, now abandoned, which is a continuation of application No. 09/284,336, filed as application No. PCT/AU97/00681 on Oct. 10, 1997, now Pat. No. 6,260,321.

(30) Foreign Application Priority Data

Oct. 11, 1996 (AU) ..... P02912

(51) Int. Cl.
*E04B 2/00* (2006.01)

(52) U.S. Cl. ..... 52/474; 52/476; 52/460; 52/461; 52/464; 52/762; 52/773; 52/281; 52/489.1

(58) Field of Classification Search ..... 52/474, 52/476, 460, 464, 762, 773, 281, 729.1, 481.1, 52/739.1, 729, 459, 461, 463, 764, 489.1, 52/730.6, 731.5, 733.3
See application file for complete search history.

(56) References Cited

U.S. PATENT DOCUMENTS 3,566,561 A * 3/1971 Tozer ..... 52/127.12

(Continued)

FOREIGN PATENT DOCUMENTS

AU 55877/69 12/1970

(Continued)

OTHER PUBLICATIONS

"Heat Sinks", *Alcan Extrusion Catalogue*, Jan. 1992, p. 26.

*Primary Examiner*—Carl D. Friedman
*Assistant Examiner*—Chi Q. Nguyen
(74) *Attorney, Agent, or Firm*—Wilmer Cutler Pickering Hale & Dorr LLP

(57) ABSTRACT

The invention concerns a building element[which is a stud (10) having a number of channels (12). Each channel can receive a cooperating means (14) which can be used to mount a panel or bracket on the stud. The invention also concerns a building element which is a joining clip (16) which can be connected to a panel or bracket. The joining clip includes the cooperating means (14) for mounting a panel or bracket on the stud. The invention also concerns a building element which is a joining element (42) which can connect one panel to another. The joining element is hinged (46). The invention also discloses two types of bracket for mounting in the stud. The first type has a screw-threaded shaft (71) and a sleeve (72) with cooperating means (73) at one end of the sleeve. The cooperating means is shaped so that it can be inserted horizontally in a channel of the stud and rotated so that the cooperating means cannot be withdrawn horizontally from the channel. The bracket may thereafter be locked into position in the channel. The second type of bracket has two arms (81, 82) at an angle to each other (83). Cooperating means (84) are located at one end of one arm (81). The cooperating means is shaped so that it can be inserted horizontally in a channel of the stud and rotated so that the cooperating means cannot be withdrawn horizontally from the channel. The one arm of the bracket may thereafter be pushed into position in the channel. A track (60) is adapted to be hung from a horizontal surface (61), the track having a gutter (59) adapted to receive a connecting clip (63) attached to an end of a panel (18), the track also having a channel (59) adapted to receive a masking clip (64) adapted to conceal the end of the channel].

5 Claims, 17 Drawing Sheets

U.S. PATENT DOCUMENTS

| | | | | | |
|---|---|---|---|---|---|
| 3,640,039 | A | * | 2/1972 | McKee et al. | 52/281 |
| 3,686,810 | A | | 8/1972 | Allen | |
| 3,760,547 | A | | 9/1973 | Brenneman | |
| 3,844,086 | A | * | 10/1974 | Radtke | 52/741 |
| 3,866,364 | A | * | 2/1975 | Pollard | 52/36.5 |
| RE30,432 | E | * | 11/1980 | Stoakes | 52/395 |
| 4,570,390 | A | * | 2/1986 | Wendt | 52/36.6 |
| 4,802,296 | A | * | 2/1989 | Kovalak, Jr. | 40/607.02 |
| 5,042,555 | A | | 8/1991 | Owens | |
| 5,452,557 | A | | 9/1995 | Posenaer | |
| 5,546,718 | A | | 8/1996 | Way | |
| 5,634,300 | A | | 6/1997 | Huebner et al. | |
| 5,638,653 | A | | 6/1997 | Rossi | |
| 5,644,878 | A | * | 7/1997 | Wehrmann | 52/287.1 |
| 5,996,299 | A | | 12/1999 | Hsueh | |
| 6,247,282 | B1 | * | 6/2001 | Searle | 52/474 |
| 6,260,321 | B1 | * | 7/2001 | Rudduck | 52/474 |
| D465,035 | S | * | 10/2002 | McFarland | D25/124 |

FOREIGN PATENT DOCUMENTS

| | | |
|---|---|---|
| AU | B-21057/77 | 7/1978 |
| AU | B-84217/82 | 12/1982 |
| CH | 374471 | 1/1964 |
| DE | 3613574 | 12/1987 |
| DE | 296 18 340 | 2/1997 |
| EP | 609951 | 8/1994 |
| EP | 730069 | 9/1996 |
| FR | 7904175 | 10/1980 |
| FR | 2679939 | 2/1993 |
| GB | 2107754 | 5/1983 |
| JP | 52107114 | 9/1977 |
| WO | 81/03043 | 10/1981 |
| WO | 91/08358 | 6/1991 |

* cited by examiner

BUILDING ELEMENTS

RELATED APPLICATIONS

This application is a continuation of U.S. patent application Ser. No. 09/874,509, filed Jun. 5, 2001 now abandoned, which is a continuation of U.S. patent application Ser. No. 09/284,336, filed Jun. 17, 1999 now U.S. Pat. No. 6,260,321, which claims the benefit of International Patent Application Serial No. PCT/AU97/00681 filed on Oct. 10, 1997, which was published under PCT Article 21(2) in English, the contents of both of which are herein incorporated by reference.

TECHNICAL FIELD

This invention relates to the construction industry; more particularly, this invention relates to certain building elements useful in construction, especially for the building of internal walls and partitions, although the invention is not necessary limited to this application.

BACKGROUND ART

For many years it has been the normal practice in the construction industry to construct internal walls from plasterboard, attached to wooden or metal studs. To install plasterboard walls with an acceptably smooth finish, and to set the joints between adjacent plasterboard panels, it is necessary to employ skilled plasterboard "setters". This not only increases costs, but influences the building timetable; to achieve maximum efficiency, a building should be prepared to the stage where all plasterboard walls can be installed at one time, so that the setters are on site for the minimum time necessary. A significant cost drawback is the fact that it is unavoidable that this work must be carried out on site.

Once the plasterboard walls have been installed, they need to be sanded before being painted. The sanding procedure creates a significant amount of gypsum dust, with a consequent effect on all articles and material on the site. Moreover, because it is necessary to paint plasterboard, the cost of painting is a significant part of building.

Should it become necessary to repair a plasterboard wall, if a professional finish is required, it is necessary to call in a plasterboard setter and to endure the dust created during the sanding procedure. In addition, it is necessary to repaint the wall after repair.

There is a further problem associated with plasterboard walls, which arises during demolition. Demolition of internal plasterboard walls is frequently necessary in commercial buildings, for example, when a tenant leaves the building. Demolition of plasterboard walls is usually also necessary during refurbishment. Plasterboard walls cannot be dismantled without substantial damage to the plasterboard, to the extent that the plasterboard is not reusable. Even more significantly, substantial gypsum dust is created. It is believed that the inhalation of gypsum dust may have a deleterious effect on health. Consequently, in some jurisdictions, safe work practices require that adjacent areas are evacuated during the demolition of plasterboard walls. This can result in loss of rent for a landlord and interruption of business and loss of profits for a tenant.

After plasterboard walls have been demolished, the plasterboard has a "negative" value in that it is necessary to pay for its removal and disposal. Plasterboard and its framing is not recyclable on an economic basis. It is an aim of the present invention to provide a construction system which can avoid the use of plasterboard panels and hence the difficulty and cost involved in construction, repair and demolition involving plasterboard panels.

It is a further object of this invention to provide a building system which can permit wall panels to be reusable.

It is a further object to provide, in one aspect of the invention, a system which can use wall panels already finished in the factory, so that painting on site is not required.

When wall panels, plasterboard or otherwise, are transported to a building site, damage frequently occurs. In many cases, the damage is relatively minor, and one side of the panel is usable.

It is an object of this invention, in one aspect, to provide a building element which will permit a panel to be erected with either side outermost.

During occupation of buildings, damage is occasionally caused to wall panels. Rather than obtain a replacement panel, it would be desirable to be able to detach the panel and reverse it so that the damaged side is concealed in the wall cavity. This invention, in one aspect, aims to provide that capability.

It is yet a further object of this invention to provide a building system which can be integrated with furniture, especially office furniture, such as work stations.

DISCLOSURE OF THE INVENTION

Accordingly, this invention provides a building element being a stud, characterised in that the stud has a plurality of channels, each channel being adapted to receive a cooperating means for the purpose of mounting a panel or bracket on the stud.

Preferably, the stud has three longitudinal channels, which ideally are set out side by side. Even more preferably, the stud has a first side and a second side opposing the first, and there is one set of three longitudinal channels arranged on the first side and a second set of three longitudinal channels arranged on the second side.

The cross-sectional shape of each channel can be determined by the way in which it is intended to receive the cooperating means. In one preferred embodiment, rather than being "U" shaped, it is preferred that each channel is formed with return rims, so that the channel is "C" shaped in cross-section; however, it is greatly preferred that the base of the channel is flat.

The stud may be manufactured from any suitable material; it has been found that aluminium is acceptable, and has the added advantage that aluminium is recyclable. However, the stud may be made from other materials.

The co-operating means for mounting panels or brackets to the stud is preferably a joining clip, which is also novel.

Consequently, this invention also provides a building element being a joining clip adapted to mount a panel or bracket to the stud of the invention, the joining clip having means for cooperating with a channel of the stud and means for connecting the joining clip to a panel or bracket.

In a preferred embodiment, the joining clip is made of plastic such a polyvinyl chloride (PVC) or other suitable material. If desired, the joining clip may have parts of varying resiliency, formed for example by multi-moulding.

Certain preferred configurations of the cooperating means are illustrated in the accompanying drawings, but the invention is not necessarily limited to these configurations.

As will be seen from the examples in the drawings, the joining clip can perform the function of providing a neat finish to the ends of panels. The clip preferably extends along the length of an edge of each panel for this reason and also to provide maximum strength and stability to the assembled wall.

The means for connecting the clip to a panel may follow, inter alia, either of two methods of construction. In the first method, the panel may be provided with a longitudinal groove in at least one edge (preferably also in the edge opposite the first), in which case the joining clip may have a protrusion, especially a saw-toothed protrusion, which is a push-fit into the groove. This method is illustrated in the drawings. In the second method, the panel end is tapered or shaped to fit within a complementary channel formed in the joining clip. In both cases, it is intended that the material of the clip and the close fit with the panel provides a stable arrangement under normal conditions, but that the use of appropriate force will separate the clip from the panel when required, for example, so that the panel can be reversed.

It is to be understood, however, that it is not an essential part of this invention that the joining clip can be removed from the panel, bracket or the like. In some applications, for example, in wet areas, the panel may be waterproof on one side only and there will be no need to be able to strip the joining piece from the panel.

In addition, the means for connecting the joining clip to a panel may be adhesive, or other suitable means.

In the case of panels around internal or external corners, a new joining element has been devised, which also forms part of the present invention. The joining element of the invention is adapted to annex a first panel to a second panel, and has first means for connecting the joining element to the first panel, second means for connecting the joining element to the second panel and hinge means located between the first and second connection means, the hinge means comprising a resilient bridge.

The connection means may be any of those described in relation to the joining clip, or any other suitable means.

The joining element may also perform the function of providing a neat and functional finish to the ends of panels, like the joining clip. The joining element preferably extends along the length of each panel end for this reason and can also provide maximum strength and stability to the assembled wall.

As indicated, a channel of the stud of the invention may be adapted to receive a cooperating means for the purpose of mounting a bracket, rather than a panel, on the stud. The bracket in turn may serve to connect furniture or panels to the stud, or may be used for other purposes.

Preferably, the bracket to be used in this context takes one of two forms. Both are provided by this invention.

Accordingly, this invention provides in one form a bracket for mounting on the building element, being a stud, of the present invention, the bracket comprising a screw-threaded shaft and a sleeve therefor, the sleeve having at one end a cooperating means adapted to be inserted in a channel of the stud, the channel having first and second ends, wherein the cooperating means is shaped so as to be capable of insertion in the channel at any location between the first and second ends and capable of manipulation to a position where the cooperating means cannot be withdrawn from the channel except at the first or second end, and wherein screwing of the shaft within the sleeve in a direction towards the channel is adapted to lock the bracket in the channel.

Preferably, the channel of the stud is "C" shaped in cross-section, except that it has a flat base. In this context, the cooperating means is preferably generally rectangular in cross-sectional shape, except that one pair of opposing corners of the rectangle are cut off or one corner is rounded off.

The longer dimension of the rectangle complements the width of the base of the channel. The shorter dimension of the rectangle enables the cooperating means to be inserted in the channel between the upstanding arms and flanges forming the channel with the base. Rotation of the cooperating means through 90 degrees, so that the longer dimension of the rectangle lies transversely to the length of the channel prevents withdrawal of the bracket from the channel. The cut-off corners (or the single rounded off corner) of the rectangle permit this rotation to take place. The bracket may then be locked into position in the channel by screwing the shaft in a direction towards the base of the channel.

In another form, this invention provides a bracket for mounting on the building element, being a stud, of the present invention, the bracket comprising a shaft having first and second arms forming an angle between them, the first arm having at one end a cooperating means adapted to be inserted in a channel of the stud, the channel having first and second ends, wherein the cooperating means is shaped so as to be capable of insertion in the channel at any location between the first and second ends and capable of manipulation to a position where the cooperating means cannot be withdrawn from the channel except at the first or second end, and wherein the first arm is adapted to fit substantially within the channel.

With this form of the bracket, it is also preferred that the channel of the stud is "C" shaped in cross-section, except that it has a flat base. In this context, the cooperating means is preferably generally rectangular in cross-sectional shape, except that one corner of the rectangle is rounded off. The longer dimension of the rectangle complements the width of the base of the channel. The shorter dimension of the rectangle enables the cooperating means to be inserted in the channel between the upstanding arms and flanges forming the channel with the base. Rotation of the cooperating means through 90 degrees, so that the longer dimension of the rectangle lies transversely to the length of the channel prevents withdrawal of the bracket from the channel. The rounded off corner of the rectangle permits this rotation to take place. As an alternative to rounding off a corner, a pair of opposing corners may be cut off, as in the case of the first embodiment of the bracket described above.

In order to permit the first arm to lie substantially within the channel, it is preferred that the cooperating means is curved in the longitudinal direction as shown in the drawings. The first arm may also have an O-ring of rubber or other resilient material to assist a tight fit of the first arm in the channel.

When the first arm lies substantially within the channel and a force is exerted on the second arm, in a direction away from the first arm, the bracket in this embodiment locks into the channel.

It will be appreciated that, with either form of the bracket of the invention, items such as furniture may be hung from the stud.

The brackets of the invention have substantial advantages over prior art brackets, because they may be inserted in a channel of the stud at any point along its length, whereas prior art brackets must enter a channel at one end thereof. This creates problems in changing furniture, for example. In addition, using the brackets of the present invention, it is possible to insert new brackets above or below existing brackets without having to remove the existing brackets from the channel. Further, removal of any bracket is a simple task, in contrast to the prior art.

The present invention also provides a ceiling track which may be used in conjunction with the building elements of the present invention. Accordingly, this invention provides a track adapted to be hung from a horizontal surface, the track having a gutter adapted to receive a connecting clip attached to an end of a panel, the track also having a channel adapted to receive a masking clip adapted to conceal the end of the channel.

The horizontal surface may be a ceiling or a beam or joist, for example. The track of the invention may be hung from the horizontal surface by any suitable means, such as by screws, nails or other fixing means.

The connecting clip preferably is shaped to complement the shape of the gutter. The connecting clip may be attached to the end of the panel by any desired method, an example of which is gluing.

The channel adapted to receive the masking clip is preferably shaped so as to provide a good friction fit with the clip.

Preferably, the track of the invention has two gutters and two channels adapted to receive masking clips.

BRIEF DESCRIPTION OF THE DRAWINGS

The invention will now be described in connection with the accompanying drawings, in which.

Figure 1:
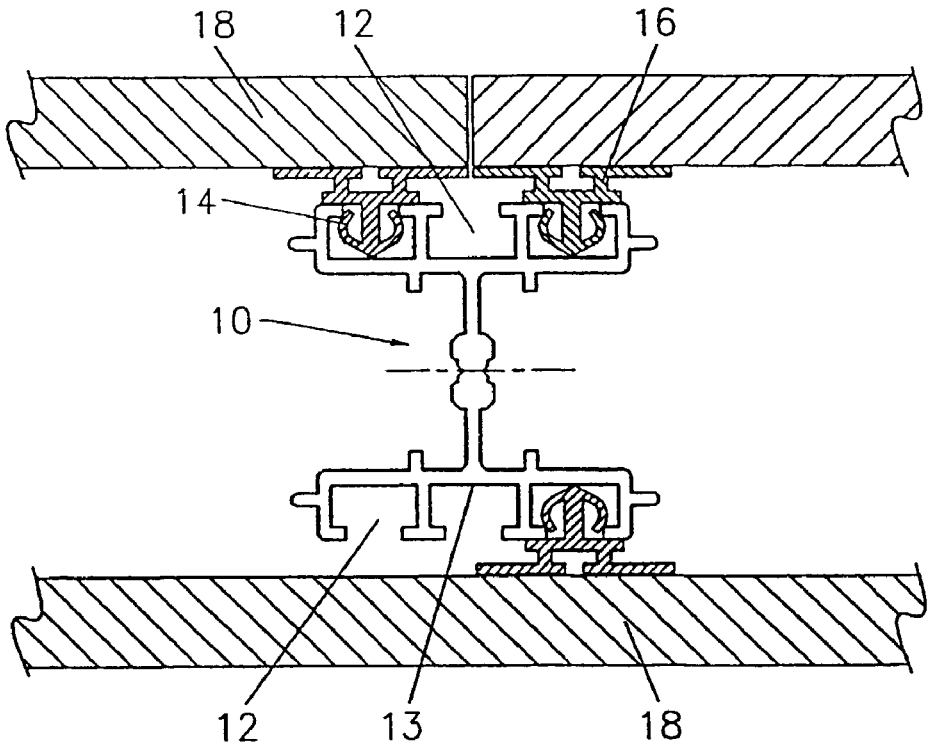
FIG. 1 is a cross-sectional plan view of the stud of the invention with wall panels affixed and one version of the joining clip of the invention.
Figure 2:
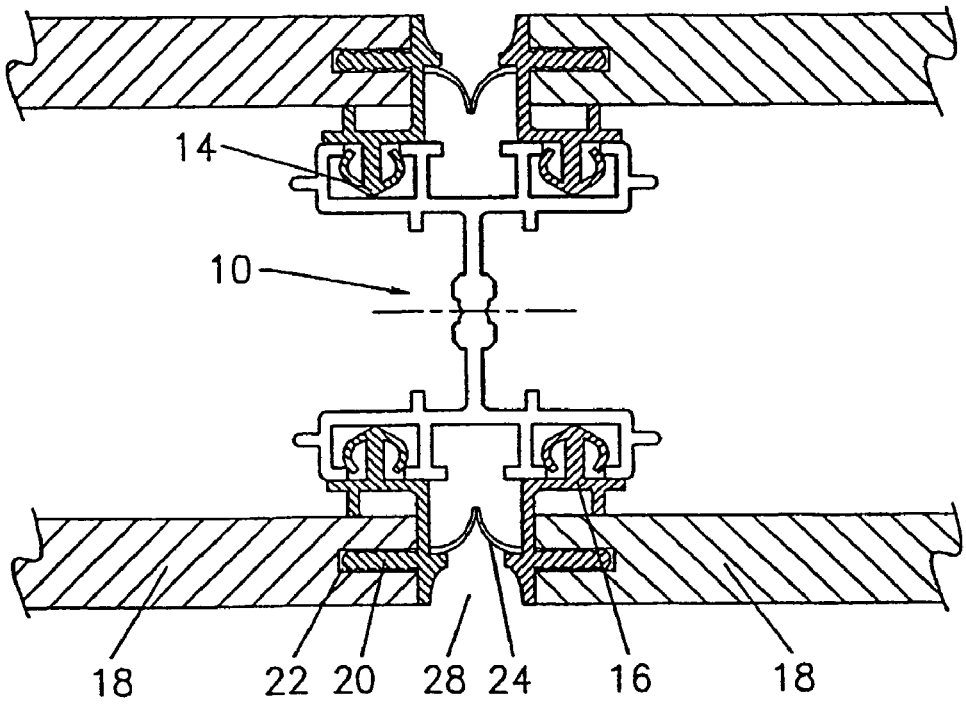
FIG. 2 is a cross-sectional plan view of the stud of the invention, showing a second version of the joining clip of the invention.
Figure 3:
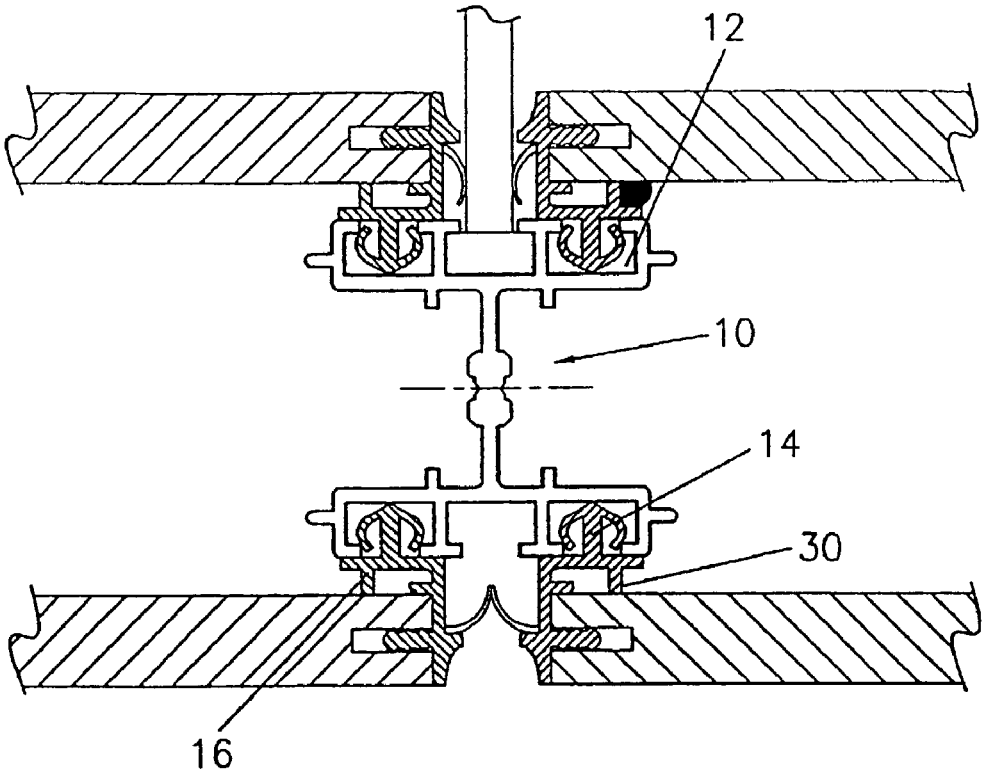
FIG. 3 shows a cross-sectional plan view of the stud of the invention, showing a third version of the joining clip of the invention.
Figure 4:
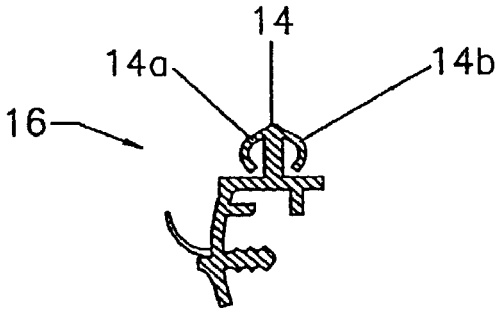
FIG. 4 shows a detail of the joining clip of FIG. 3.

In the drawings, especially FIGS. 1 to 3, stud 10 has two sets of three identical channels 12, each being "C" shaped, but with a flat base 13. Channels 12 are shaped so that each cooperating means 14 on joining clip 16, with relatively resilient arms 14*a* and 14*b* (refer FIG. 4), forms a hermetic seal when pushed into channel 12.

In FIG. 1, clip 16 is attached to panel 18 by gluing or other suitable means. In FIG. 2, however, clip 16 is attached to panel 18 by pushing protrusion 20 into groove 22 in panel 18. Extension 24 on clip 16 closes off gap 28 between panels 18. Extension 24 may be of a softer material than the rest of clip 16.

Leg 30 on clip 16 (see FIG. 3, for example) serves to space panel 18 from stud 10.

Figure 5:
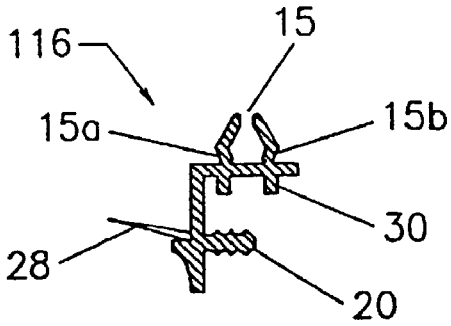
FIG. 5 illustrates a fourth version of the joining clip of the invention.
Figure 6:
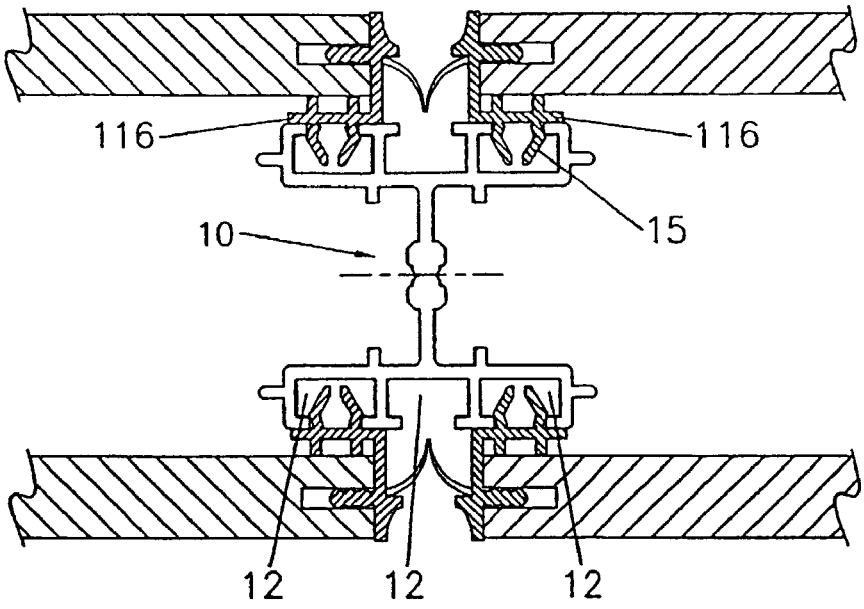
FIG. 6 shows in cross-sectional plan view the joining clip of FIG. 5 in conjunction with the stud of the invention (in slightly modified form)

In FIGS. 5 and 6, joining clip 116 has, as well as protrusion 20 and extension 28, cooperating means 15 with angled arm portions 15*a* and 15*b*, designed to clip into channel 12, as seen in FIG. 6.

Figure 7:
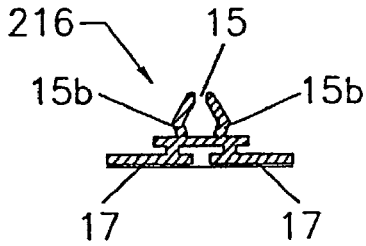
FIG. 7 illustrates a fifth version of the joining clip of the invention.
Figure 8:
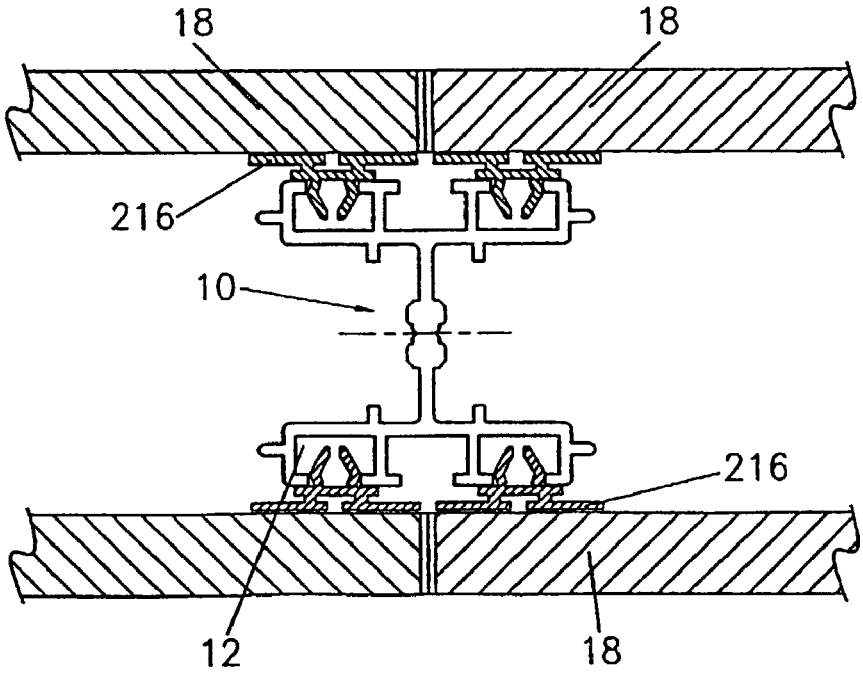
FIG. 8 shows a cross-sectional plan view of the stud of the invention (as per FIG. 6), in conjunction with the joining clip of FIG. 7.

The joining clip 216 in FIGS. 7 and 8 is similar to clip 16 in FIG. 1, in that it is attached to panels 18 by gluing along surfaces 17. However, clip 216 in FIG. 7 has the same cooperating means 15 as clip 116 in FIG. 5.

Figure 9:
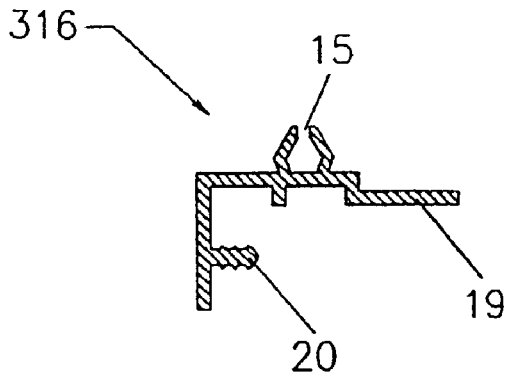
FIG. 9 shows a sixth version of the joining clip of the invention.
Figure 10:
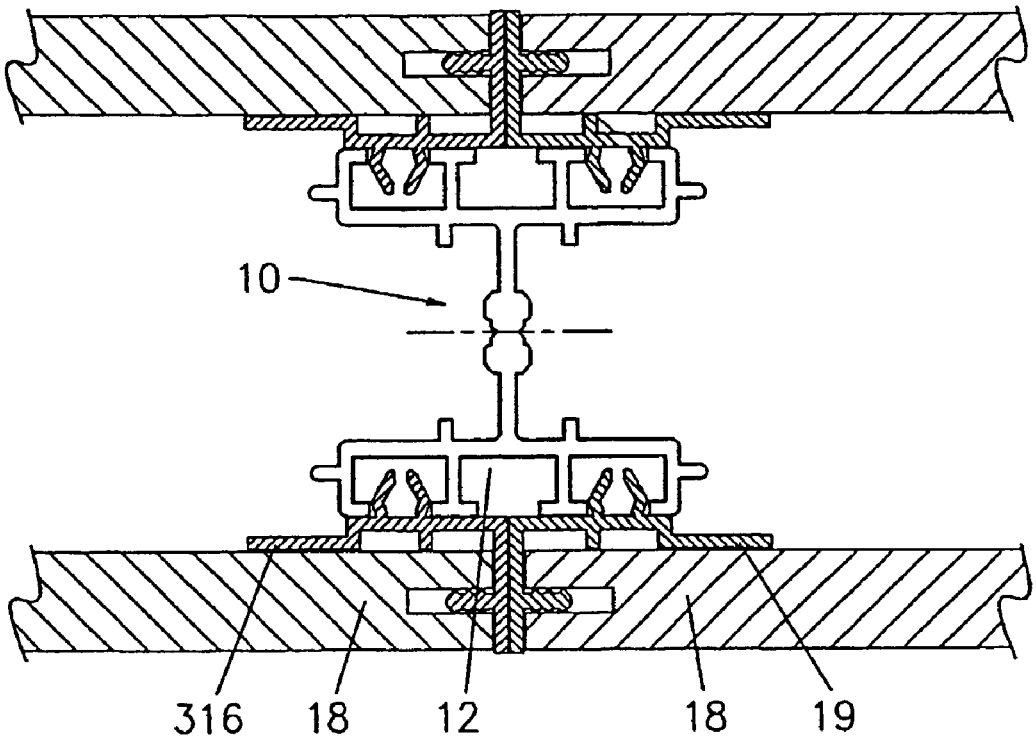
FIG. 10 shows in cross-sectional plan view the stud of FIG. 6 in conjunction with the joining clip of FIG. 9.

The joining clip 316 in FIGS. 9 and 10 is particularly suitable for imparting a finished appearance to abutting panels 18 and can provide added stability through extension 19. Cooperating means 15 is the same as that in FIGS. 5 and 7.

Figure 11:
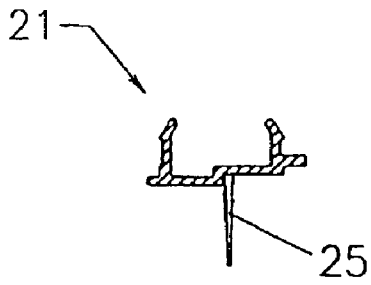
FIG. 11 shows detail of a cover trim.
Figure 12:
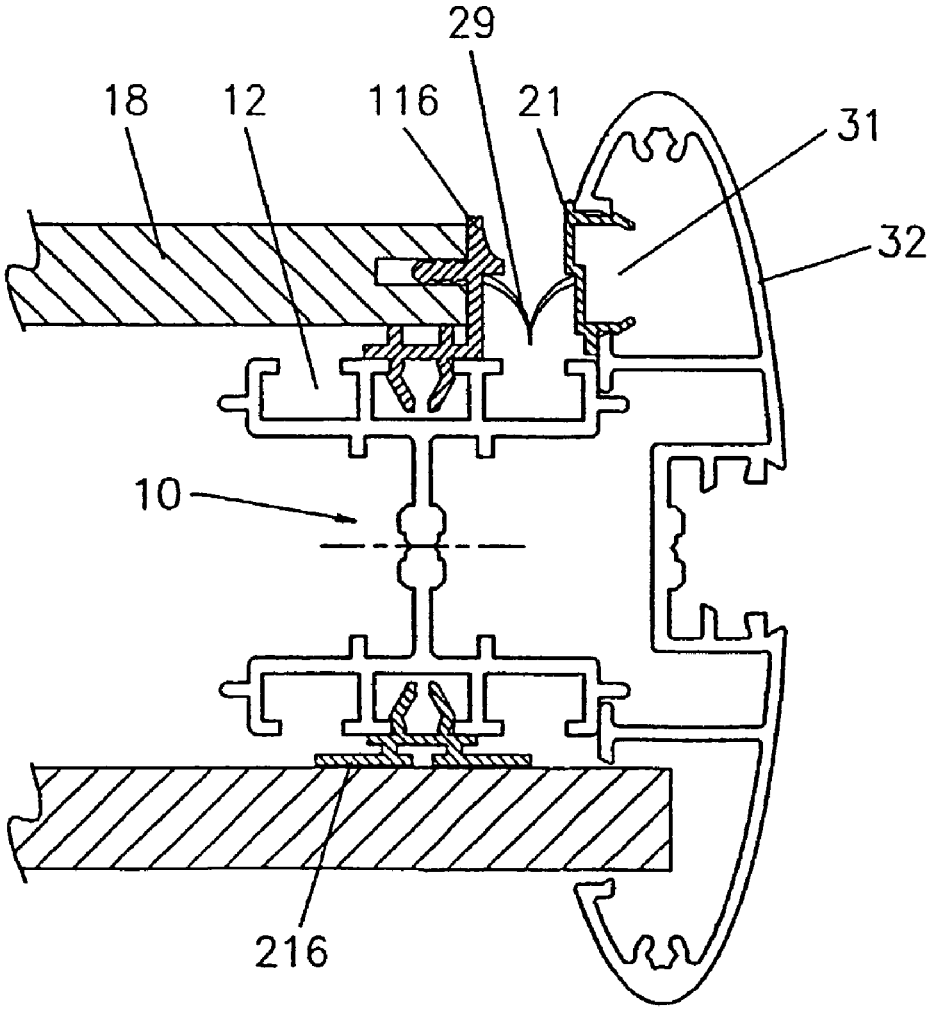
FIG. 12 is a cross-sectional plan view of the stud of FIG. 6, illustrating the use of the joining clip of FIG. 7 as well as a seventh version of the joining clip of the invention.

FIGS. 11 and 12 show trim 21 with extension 25 which works with extension 24 on clip 116 (see FIG. 12) to close off gap 29 between panel 18 and extrusion 32. In addition, trim 21 fits into gap 31 of decorative extrusion 32.

Figure 13:
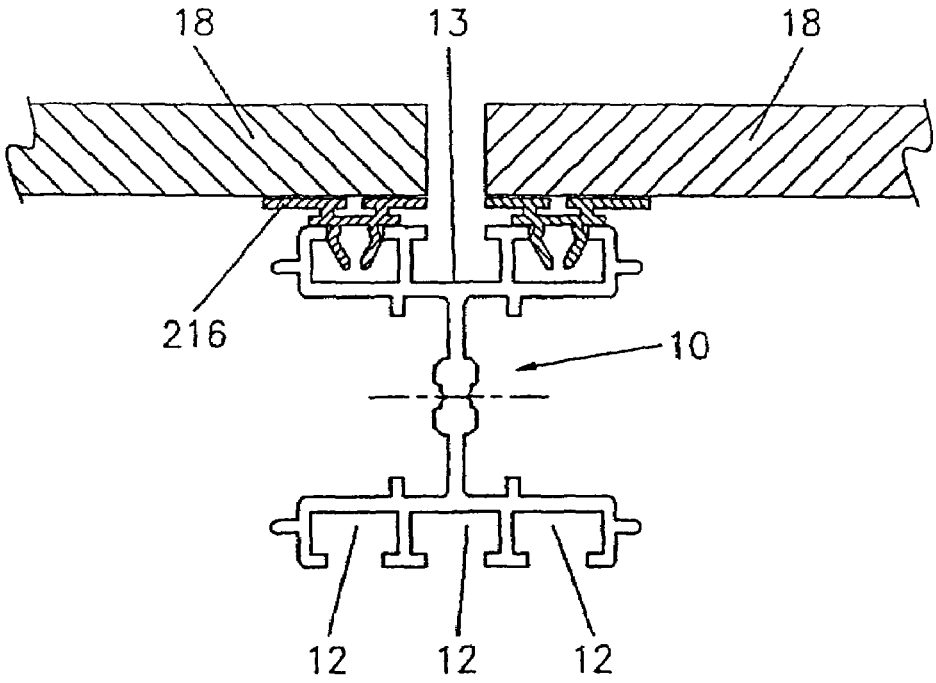
FIG. 13 is a cross-sectional plan view of the stud of FIG. 6, illustrating the use of the joining clip of FIG. 7, and showing how the gap between panels may be treated.

FIG. 13 details how base 13 of centre channel 12 may be painted; base 13 can be seen between panels 18 and its painted colour may tone or contrast with that of panels 18.

Figure 14:
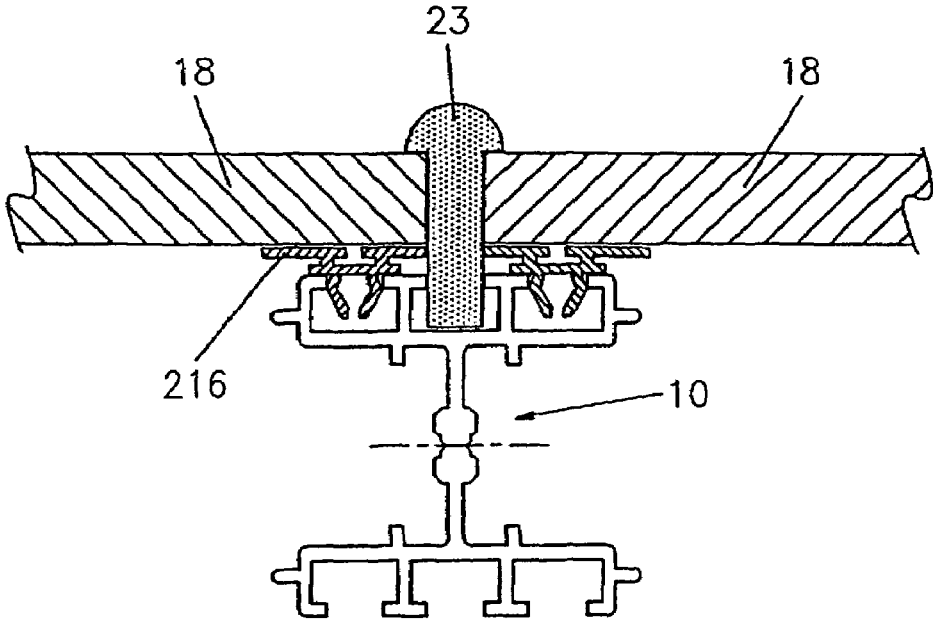
FIG. 14 is a cross-sectional plan view of the stud of FIG. 6, illustrating the use of the joining clip of FIG. 7, showing a different treatment of the gap between panels.

FIG. 14 shows the insertion of a moulding 23 in the gap between panels 18.

Figure 15:
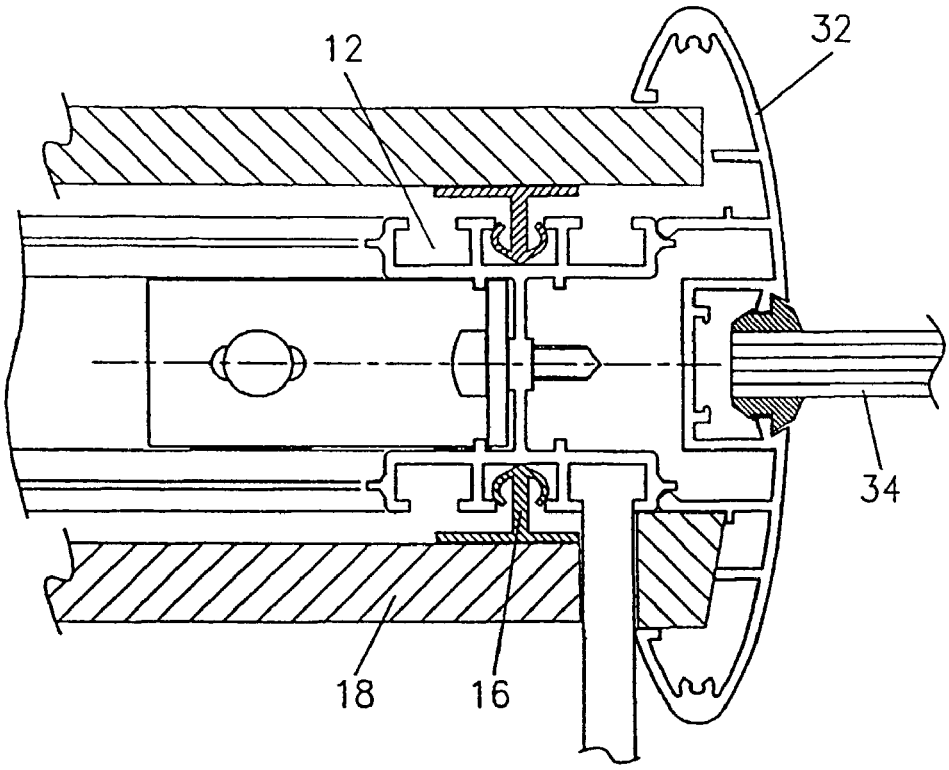
FIG. 15 shows how wall panels can be integrated with a glass panel, using a suitably shaped decorative extrusion, the joining clip being similar to that in FIG. 1.
Figure 16:
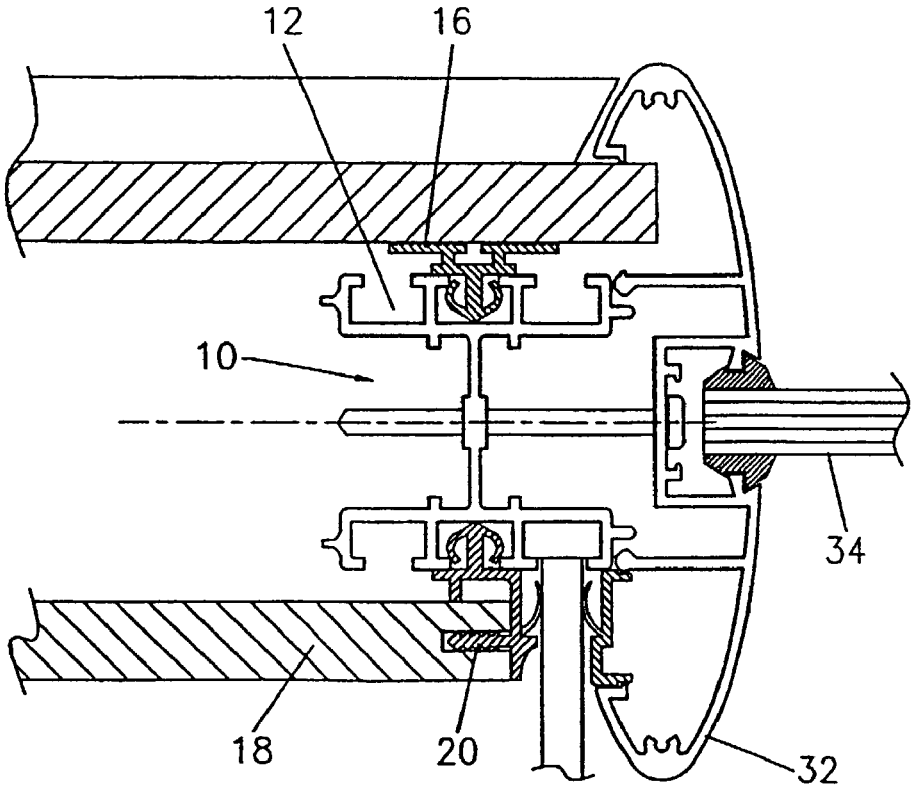
FIG. 16 is similar to FIG. 15, except that the joining clip is that in FIG. 2.

In FIGS. 15 and 16, decorative extrusion 32 neatly ends the wall system and provides a fixing facility for glass panel 34.

Figure 17:
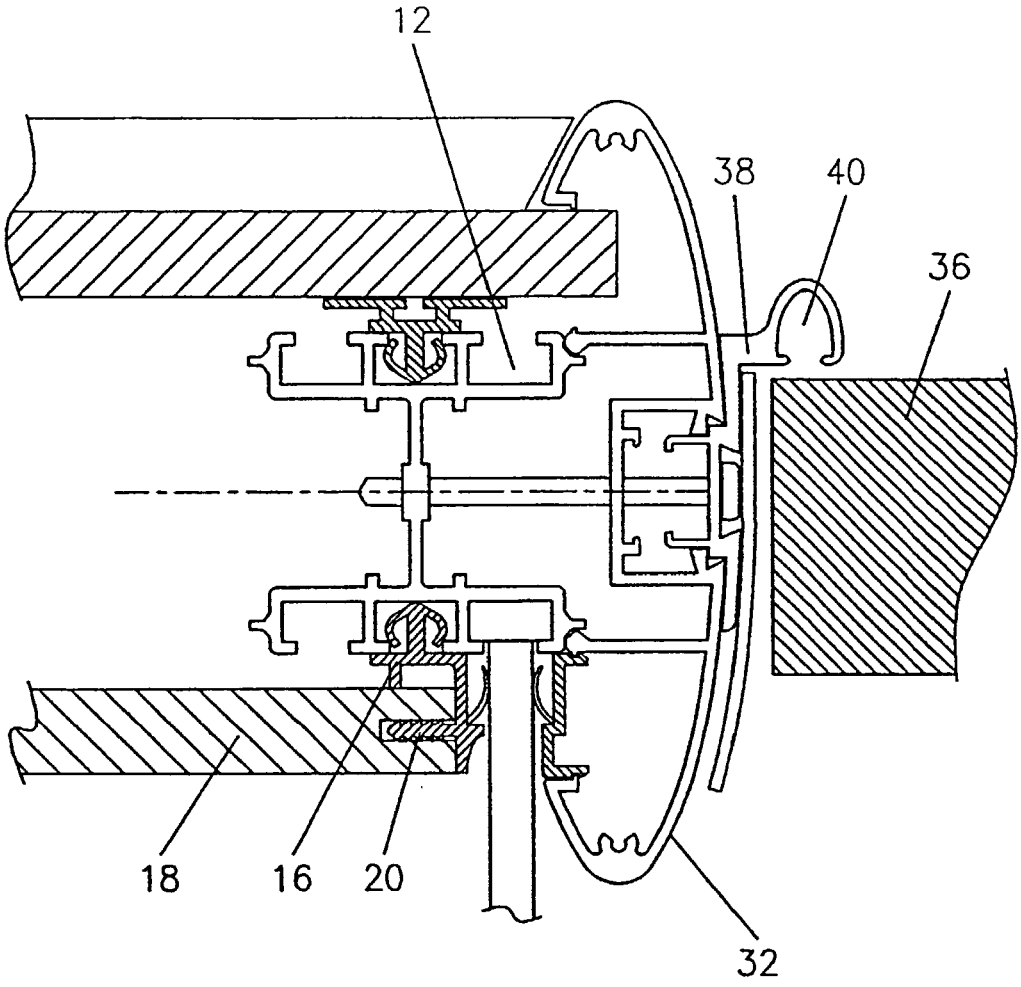
FIG. 17 shows integration of the wall panels with a door, once again, using a suitable decorative extrusion.

FIG. 17 shows door 36 integrated with the wall system of the invention but includes extrusion 38 which carries a channel 40 for a felt (not shown) or other insulating strip.

Figure 18:
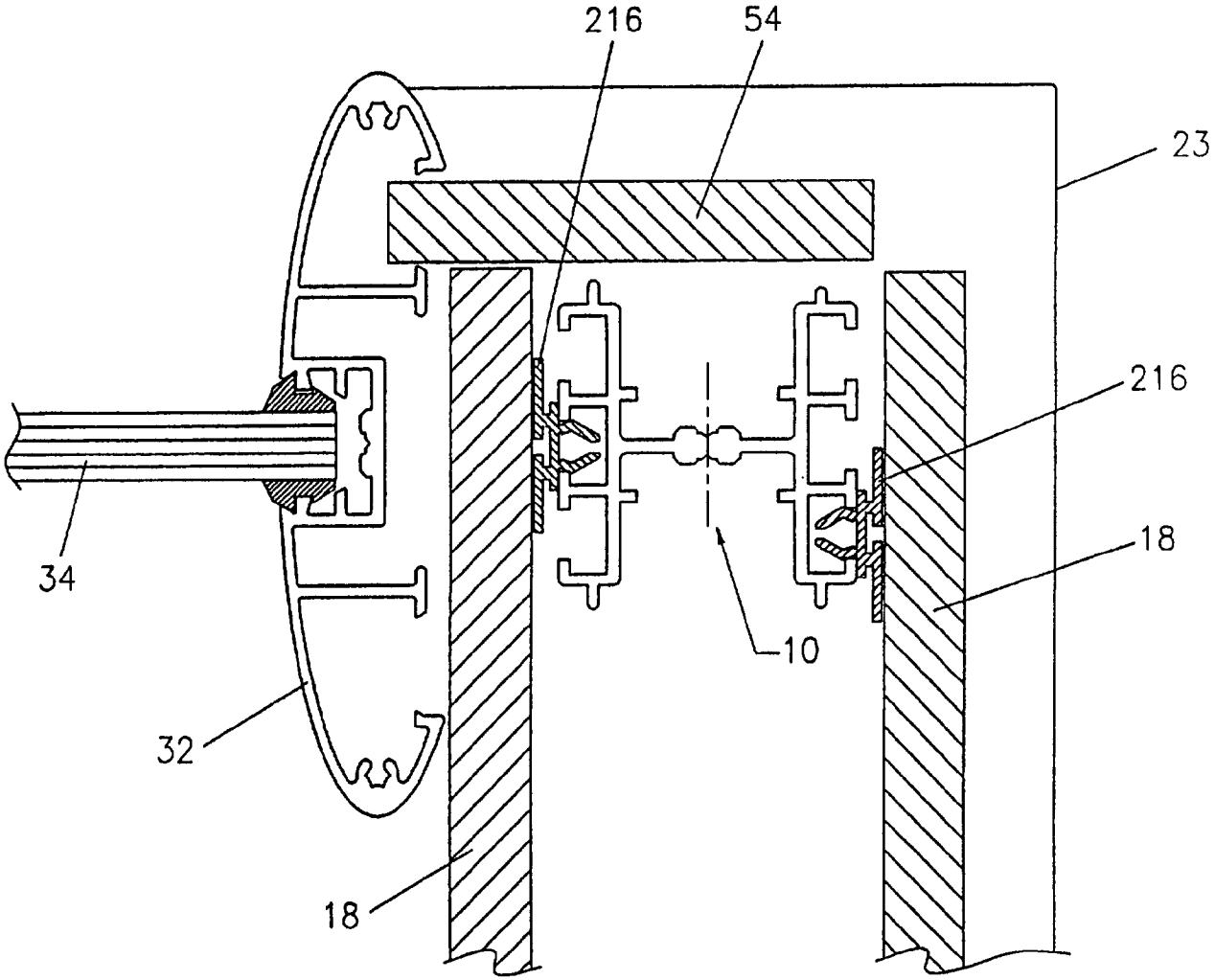
FIG. 18 illustrates in cross-section an assembly of the stud and joining clips of the invention at a corner and including a glass panel.

In FIG. 18, panels 18 form a wall end with end panel 54. It will be noted in this drawing that clips 216 are offset relative to each other; this illustrates the versatility of the stud of the present invention.

Figure 19:
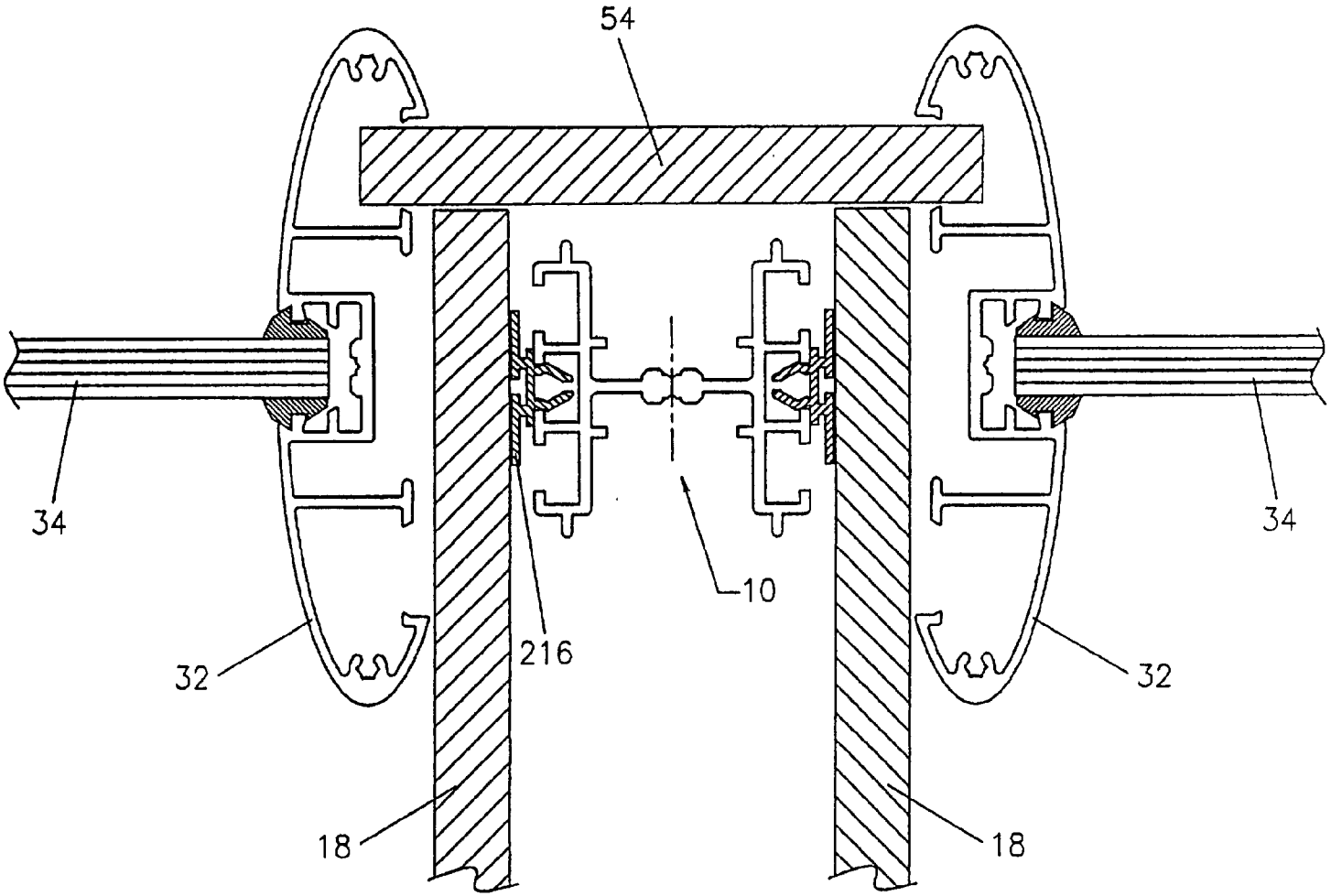
FIG. 19 illustrates in cross-section an assembly of the stud and joining clips of the invention at a wall end and including two glass panels.

FIG. 19 shows merely one arrangement of wall end and glass panels 34.

Figure 20:
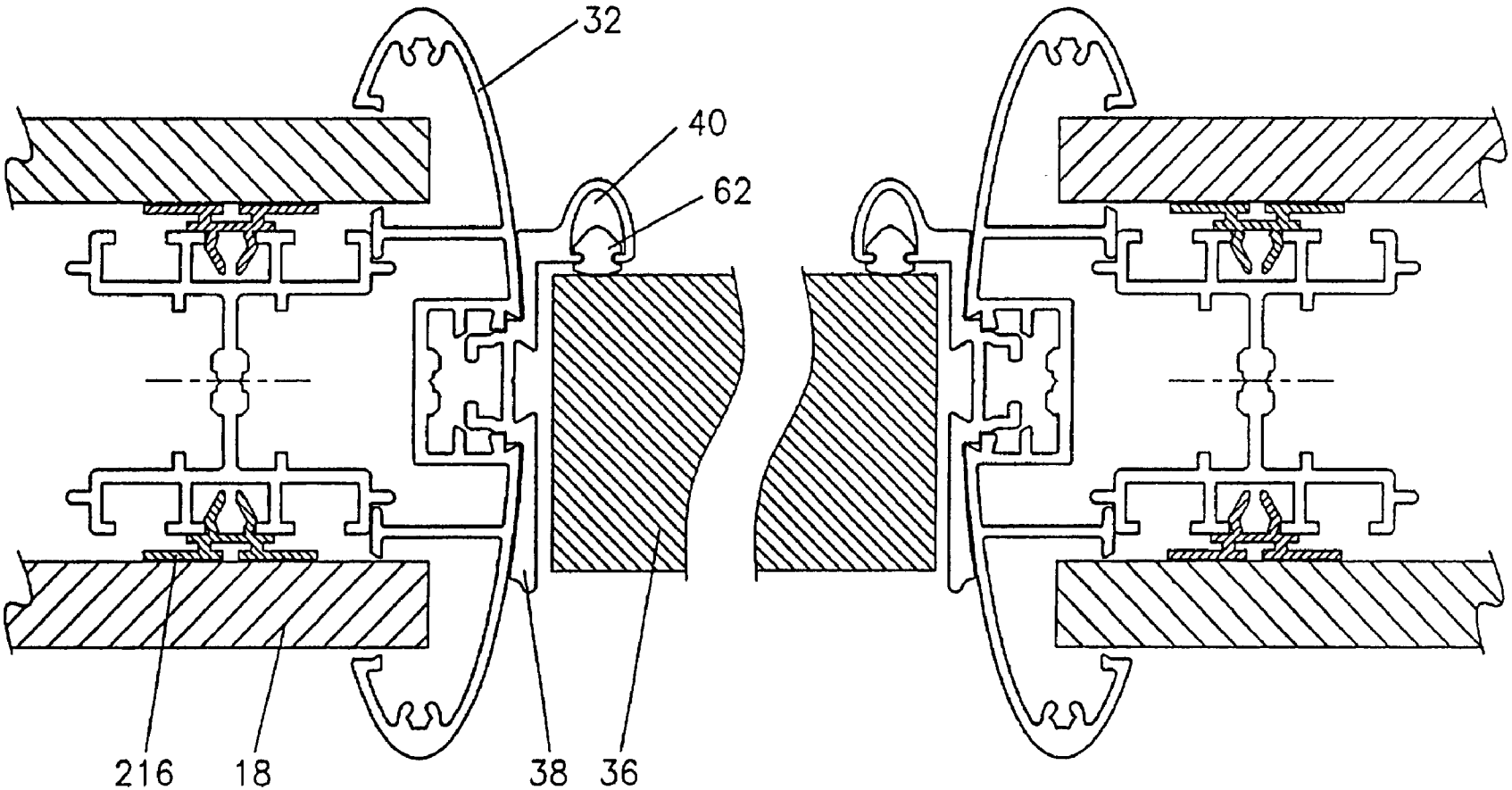
FIG. 20 shows an assembly including door jambs.

FIG. 20 illustrates how door 36 may be mounted between walls using the system of the invention. Felt 62 is shown in channel 40 of extrusion 38.

Figure 21:
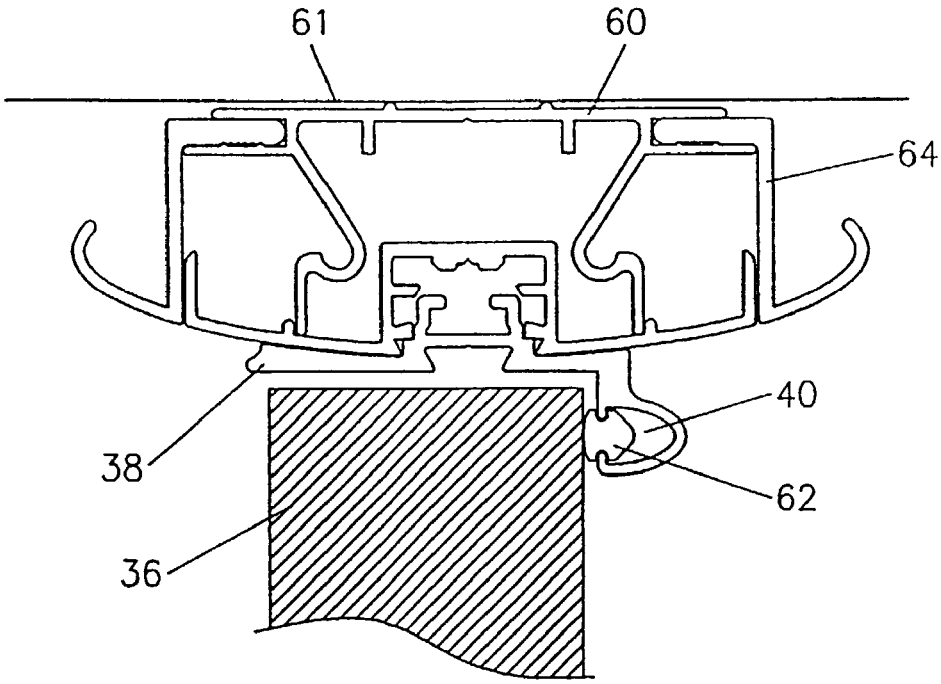
FIG. 21 is a vertical section of a door top, showing how the track of the invention may be utilised as a lintel.

FIG. 21 shows how the same extrusion 38 may be used to provide a rest at the top of door 36, in the form of felt or rubber 62 in channel 40. Track 60 is attached to ceiling 61 and also secures extrusion 38 and provides a mount for masking clips 64. Each masking clip 64 has an arm 58 which is a push fit into channel 57 in track 60.

Figure 22:
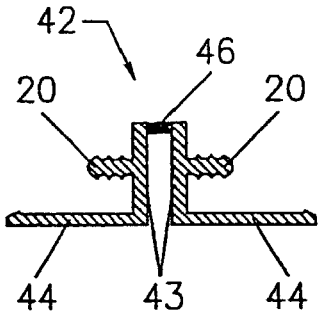
FIG. 22 shows one embodiment of the joining element of the invention.
Figure 23:
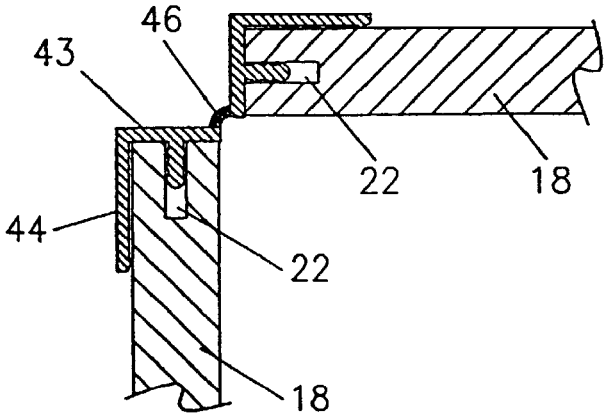
FIG. 23 shows in cross-sectional plan view the joining element of FIG. 22 joining panels around an external corner.

In FIGS. 22 and 23, joining element 42 has protrusions 20 which fit into grooves 22 of panels 18. Joining element 42 permits panels 18 to form an external corner, so that faces 43 and 44 provide a neat finished appearance.

Hinge 46 connects faces 43. Because hinge 46 is resilient, it allows panels 18 to adopt a configuration that is other than 90 degrees. This is useful to form both normal corners and unusual angles; even normal corners are rarely at exactly 90 degrees, and the joining element of the invention accommodates this discrepancy.

Figure 24:
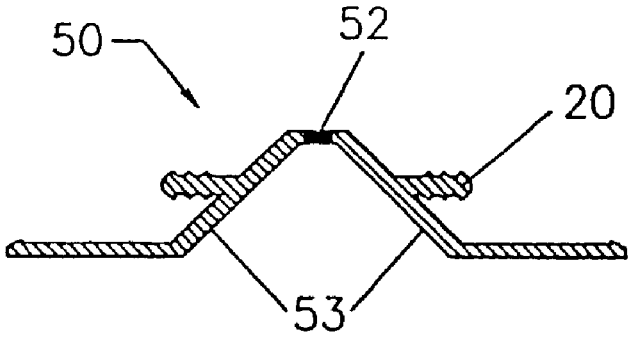
FIG. 24 shows a second embodiment of the joining element of the invention.
Figure 25:
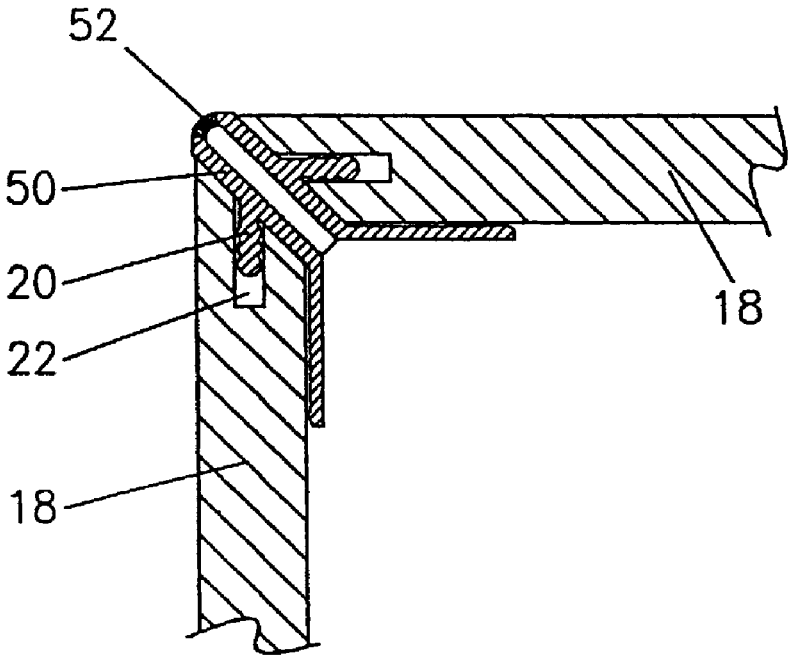
FIG. 25 shows in cross-sectional plan view the joining element of FIG. 24, joining panels around an internal corner.

In FIGS. 24 and 25, joining element 50 has protrusions 20 which fit into grooves or channels 22 in panels 18, which can form an external corner. Hinge 52 connects faces 53. In the external corner formed, hinge 52 provides a neat finished appearance.

Figure 26:
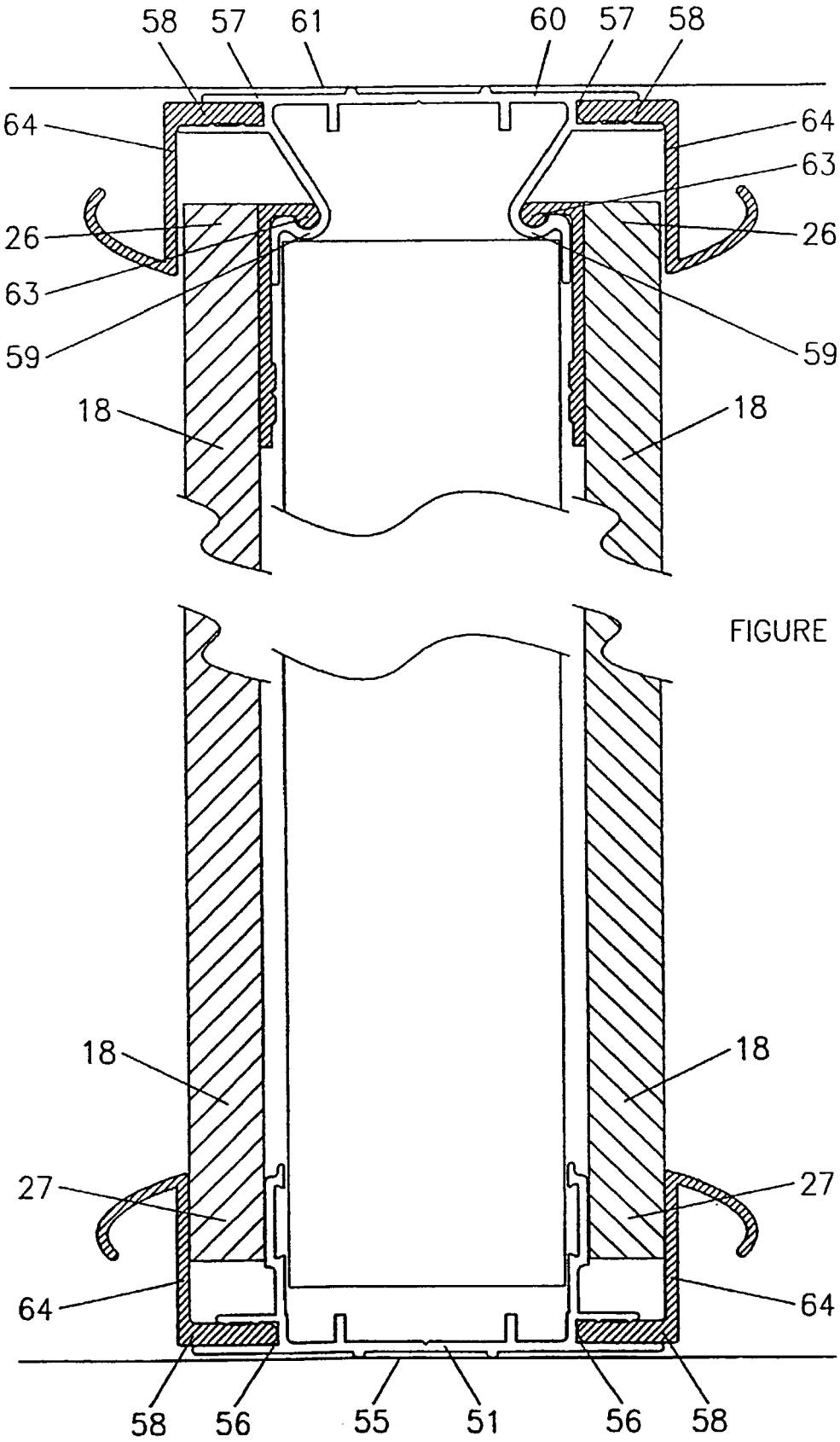
FIG. 26 shows in vertical section the track of the invention used to hang panels, with masking clips top and bottom.

FIG. 26 shows the same track 60 as in FIG. 21, but this time panels 18 are supported by track 60, by hooking protrusions 63 into gutters 59. The top ends 26 of panels 18 are covered by masking clips 64, with arms 58 push-fitted into channels 57.

The lower ends 27 of panels 18 are also covered by masking clips 64, arms 58 of which are a push-fit into channels 56 of track 51. Track 51 is attached to floor 55.

Figure 27:
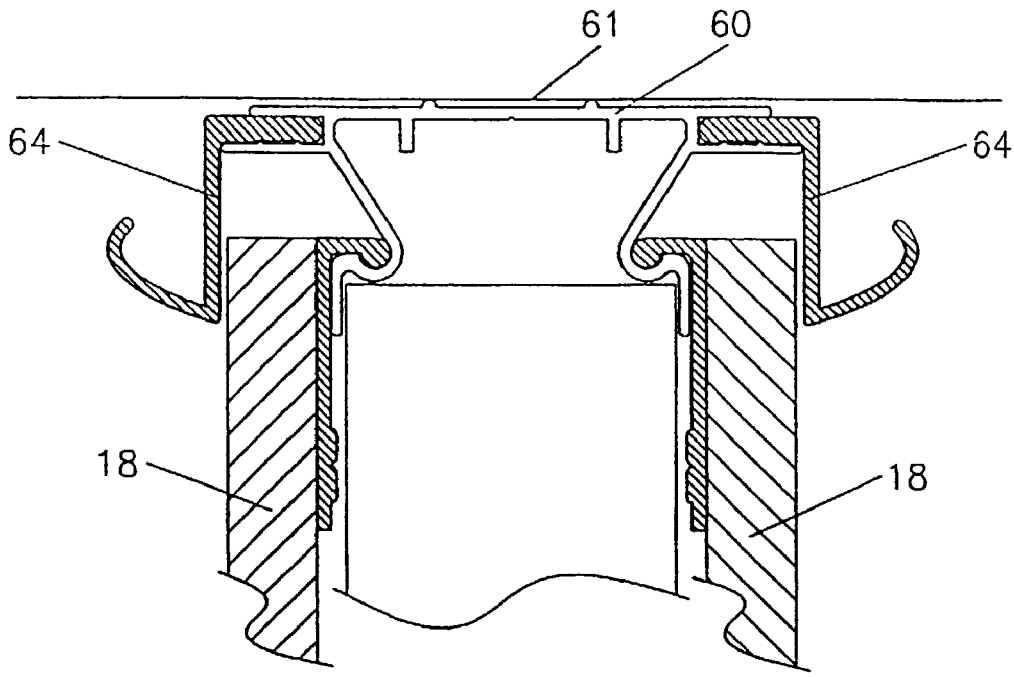
FIG. 27 is similar to FIG. 26, except that the masking clip at the bottom of the panels is different.
Figure 27:
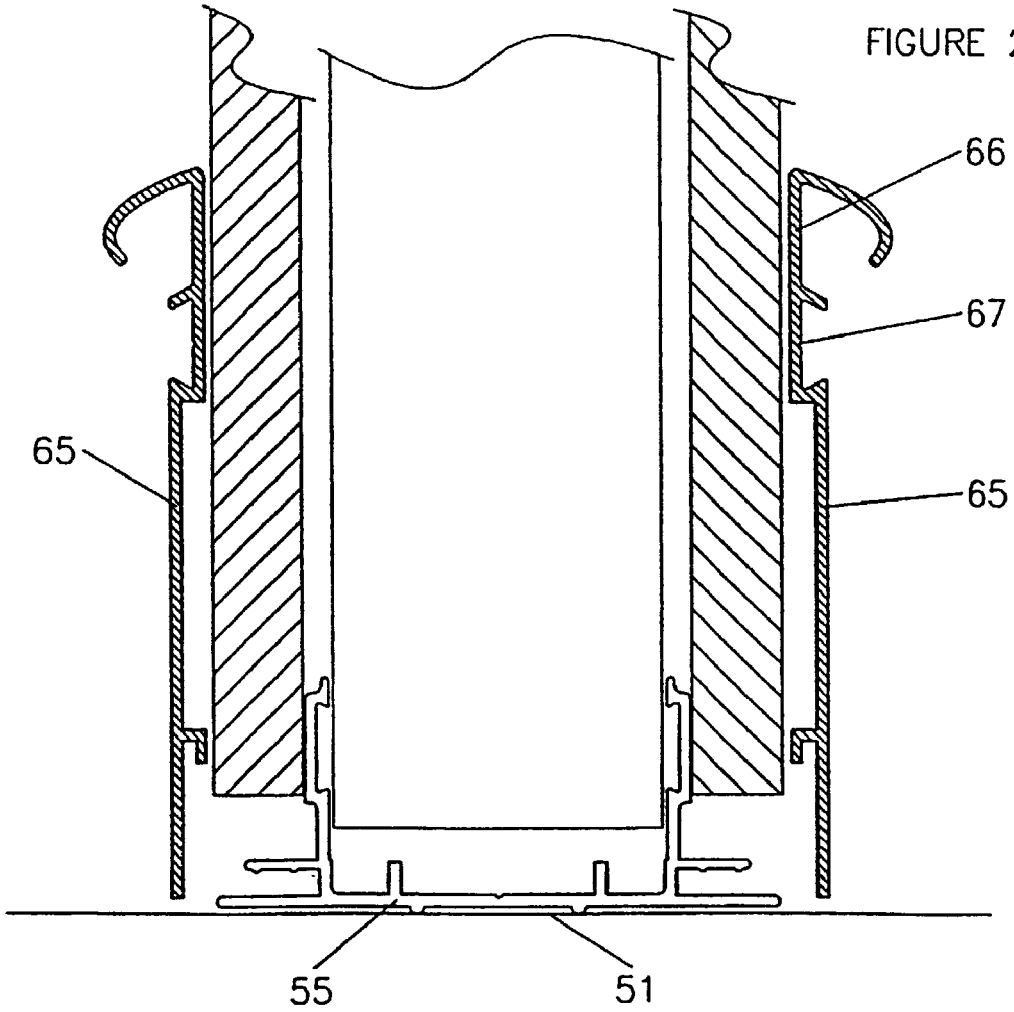
Figure 28:
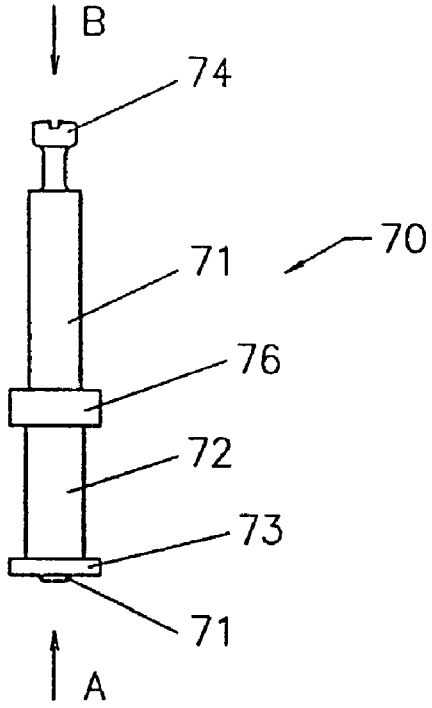
FIG. 28 is a side elevation of one form of a bracket according to the invention.
Figure 29:
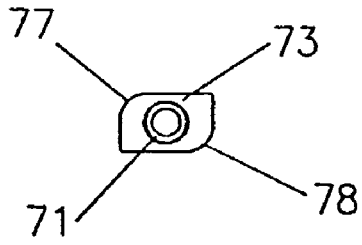
FIG. 29 is a plan view, in direction A, of the bracket of FIG. 28.

FIG. 27 has the same top arrangement as that in FIG. 26. However, the arrangement at the lower ends 27 of panels 18 is different, in that instead of masking clips 64, skirting extrusion 65 is attached to panels 18, either by gluing on surface 66 or by screwing through notch 67.

Turning now to FIGS. 28 to 31, bracket 70 is made of metal or other suitable material or combinations of material, and has shaft 71 inserted in sleeve 72. Shaft 71 is screw threaded for all or the lower part of its length contained within sleeve 72. Shaft 71 has a screw head 74 containing a slot 75 to accept the blade of a screwdriver or other suitable tool.

Sleeve 72 has at one end cooperating means 73 and at the other end a flange 76. As may be seen in FIG. 29, cooperating means 73 is shaped in end view to resemble a rectangle except that one pair of opposing corners is cut off (refer 77 and 78). Flange 76 has the same cross-sectional shape as cooperating means 73.

Figure 30:
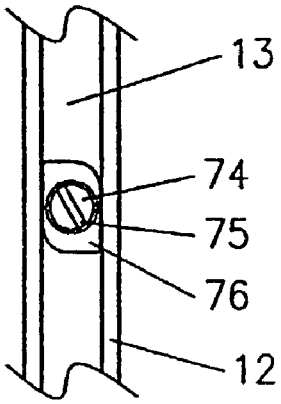
FIG. 30 shows a plan view of the bracket of FIG. 28, in direction B, after initial insertion in a channel of the stud of the invention.
Figure 31:
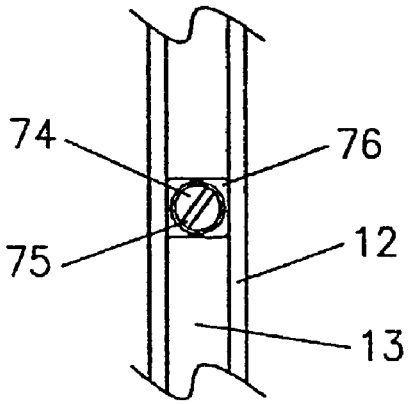
FIG. 31 shows a plan view of the bracket of FIG. 28, in direction B, locked into a channel of the stud of the invention.
Figure 32:
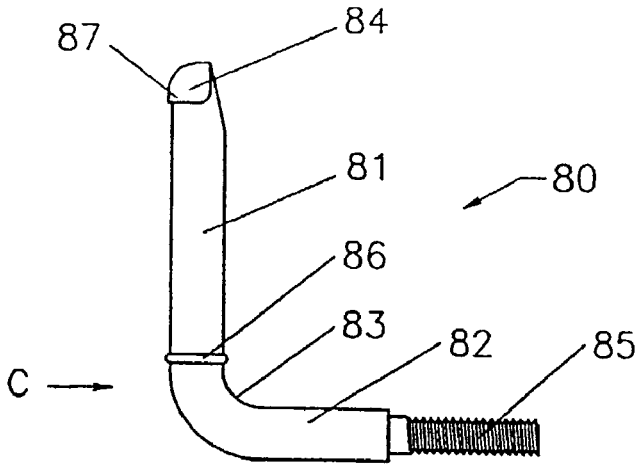
FIG. 32 is a side elevation of a second form of bracket according to the invention.
Figure 33:
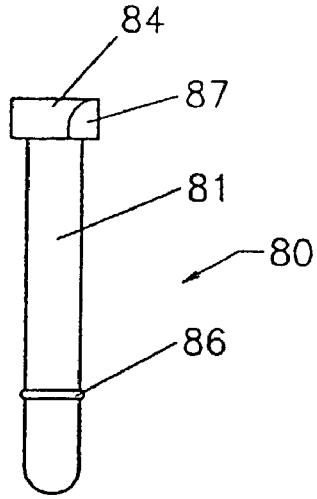
FIG. 33 is an end view of the bracket of FIG. 32, in direction C.
Figure 34:
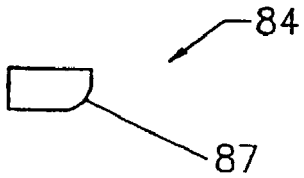
FIG. 34 is a top view of the head of the bracket in FIG. 32.

As can be seen in FIG. 30, cooperating means 73 can be inserted horizontally into channel 12 of a stud 10, and then rotated through 90 degrees to be retained in channel 12 as shown in FIG. 31. Screwing of shaft 71 towards base 13 of channel 12 (by using a blade inserted in slot 75) will lock bracket 70 into channel 12. Furniture components or other items, including panels, may then be attached to shaft 71, as desired.

The cross-sectional shape of flange 76 echoes that of cooperating means 73, so that the orientation of cooperating means in channel 12 can be ascertained.

Turning now to FIGS. 32 to 35, metal bracket 80 has two arms, 81 and 82, forming between them a right angle 83. Arm 81 has cooperating means 84. Arm 82 has screw threaded extension 85, for attaching furniture components or other building components, as desired.

Figure 35:
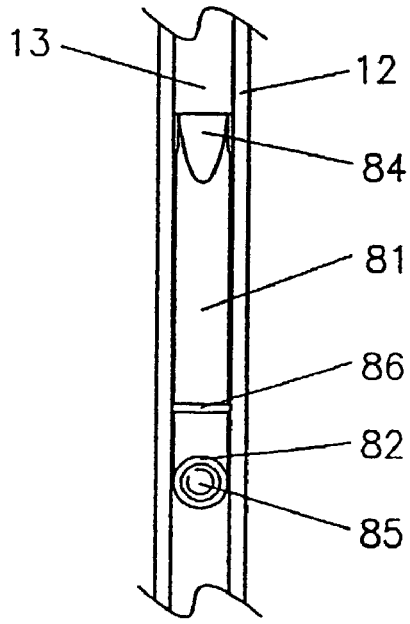
FIG. 35 shows the bracket of FIG. 32 locked into a channel of a stud of the invention.

O-ring 86 mounted on arm 81 helps to ensure a snug fit of arm 81 within channel 12 (refer FIG. 35).

Cooperating means 84 is generally rectangular in shape, except that one corner is rounded off at 87. The purpose of this is so that cooperating means 84 may be inserted in channel 12 of a stud 10, in a similar manner to cooperating means 73 of bracket 70, then rotated horizontally through 90 degrees with the assistance of rounded off corner 87, trapping bracket 80 in channel 12. Bracket 80 may then be rotated vertically through 90 degrees, so that arm 81 is caused to lie substantially within channel 12, o-ring 86 serving to wedge arm 81 in this position.

It will be appreciated by one skilled in the art that a load placed on arm 82 will enhance the locking of bracket 80 in channel 12.

It will be readily appreciated by one skilled in the art that cooperating means 14 in the embodiment shown in some of the drawings (such as FIGS. 1, 2 and 3) has the considerable advantage of sealing panel 18 hermetically, for the length of the panel 18. This means that the system of the invention can provide substantial insulation against transmission of noise and the conductivity of heat and cold. There are also obvious advantages in dealing with "wet" areas, such as bathrooms.

INDUSTRIAL APPLICABILITY

The building elements, brackets and track of the invention are clearly a substantial advance in the art. The examples referred to herein are illustrative and are not to be regarded as limiting the scope of the invention.

What is claimed is:

1. A stud comprising:

a first set of three or more channels and a second set of three or more channels, each channel in each set being adapted to receive a cooperating means for mounting a panel or a bracket on the stud, the first set of channels being parallel to and spaced from the second set of channels by spacing means, characterized in that the spacing means provides a direct connection between the first set of channels and the second set of channels, the spacing means being located inboard of the outer two channels of each set and further characterized in that each channel is formed by a base and side walls, an opening for each channel being located between the side walls, the bases of the channels being aligned, and the openings of the channels of the first set facing outwardly in an opposite direction to the openings of the channels of the second set.

2. The stud of claim 1, wherein each set of channels has three longitudinal channels.

3. The stud of claim 1, wherein the spacing means compromises a single web.

4. The stud of claim 1, wherein each channel is "U" shaped in cross-section.

5. The stud of claim 1, wherein the stud is aluminum.

* * * * *